US010344586B2

(12) United States Patent
Korherr et al.

(10) Patent No.: US 10,344,586 B2
(45) Date of Patent: Jul. 9, 2019

(54) DRILLING APPARATUS FOR PRODUCING A CASED BORE AND METHOD FOR OPERATING A DRILLING APPARATUS

(71) Applicant: BAUER Maschinen GmbH, Schrobenhausen (DE)

(72) Inventors: Werner Korherr, Koenigsmoos (DE); Werner Josef Harthauser, Wertingen (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 344 days.

(21) Appl. No.: 15/095,796

(22) Filed: Apr. 11, 2016

(65) Prior Publication Data

US 2016/0305234 A1 Oct. 20, 2016

(30) Foreign Application Priority Data

Apr. 17, 2015 (DE) ..... 10 2015 105 908

(51) Int. Cl.
*E21B 47/09* (2012.01)
*E02D 7/00* (2006.01)
(Continued)

(52) U.S. Cl.
CPC ..... *E21B 47/09* (2013.01); *E02D 7/00* (2013.01); *E21B 3/02* (2013.01); *E21B 3/03* (2013.01);
(Continued)

(58) Field of Classification Search
CPC . E21B 47/09; E21B 3/02; E21B 19/24; E21B 15/003; E21B 7/20; E21B 7/002; E21B 3/03; E21B 44/00; E02D 7/00
See application file for complete search history.

(56) References Cited

U.S. PATENT DOCUMENTS 3,565,190 A * 2/1971 Ishii ..... E21B 7/002 175/171
5,082,069 A 1/1992 Seiler et al.
(Continued)

FOREIGN PATENT DOCUMENTS

CA 2751079 A1 8/2010
CN 1944939 * 4/2007
(Continued)

OTHER PUBLICATIONS

Search Report issued by the Chinese Patent Office dated Oct. 13, 2017, which corresponds to CN201610233393.X and is related to U.S. Appl. No. 15/095,796.
(Continued)

*Primary Examiner* — David J Bagnell
*Assistant Examiner* — Jonathan Malikasim
(74) *Attorney, Agent, or Firm* — Studebaker & Brackett PC

(57) ABSTRACT

The invention relates to a drilling apparatus for producing a cased bore with a first drill drive for driving a drill rod in a rotating manner, at the lower end of which a drilling tool for removing ground material is arranged, a mast, along which the first drill drive is movable with a sledge, and a second drive, with which a support tube for the bore can be introduced into the ground. According to the invention a computer unit is provided, in which a current drilling depth of the drilling tool and a depth of introduction of the support tube are indicated. Furthermore, a monitor is provided, on which the current drilling depth in relation to the depth of introduction of the support tube can be displayed by the computer unit. The invention further relates to a method for operating such a drilling apparatus.

20 Claims, 3 Drawing Sheets

Figure 1:
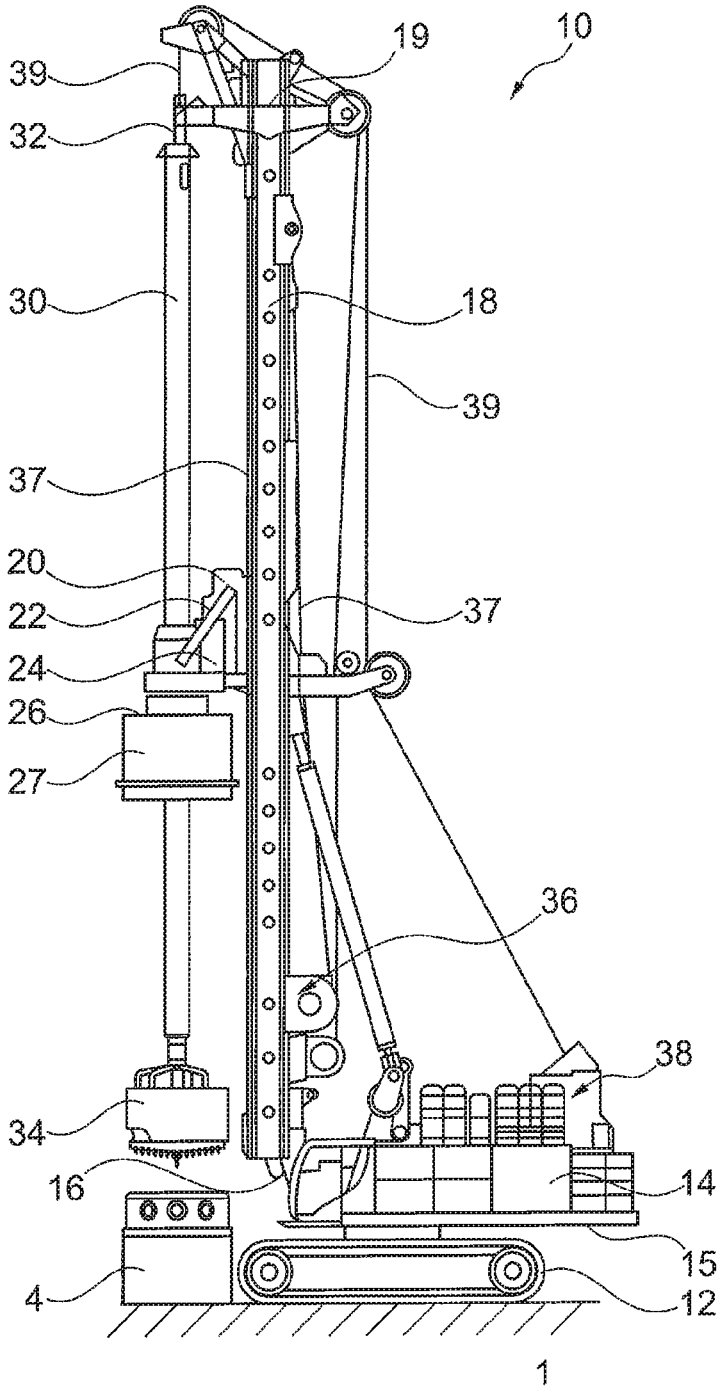

(51) Int. Cl.

| | |
|---|---|
| ***E21B 44/00*** | (2006.01) |
| ***E21B 3/03*** | (2006.01) |
| ***E21B 7/00*** | (2006.01) |
| ***E21B 7/20*** | (2006.01) |
| ***E21B 3/02*** | (2006.01) |
| ***E21B 15/00*** | (2006.01) |
| ***E21B 19/24*** | (2006.01) |

(52) U.S. Cl.
CPC ..... *E21B 7/002* (2013.01); *E21B 7/20* (2013.01); *E21B 15/003* (2013.01); *E21B 19/24* (2013.01); *E21B 44/00* (2013.01)

(56) References Cited

U.S. PATENT DOCUMENTS

| | | | | |
|---|---|---|---|---|
| 5,255,751 | A | 10/1993 | Stogner | |
| 6,601,658 | B1 | 8/2003 | Downton | |
| 7,912,678 | B2 | 3/2011 | Denny et al. | |
| 8,857,510 | B2 * | 10/2014 | Rasmus | E21B 47/024 166/255.1 |
| 9,365,997 | B2 * | 6/2016 | McMillan | E02D 3/08 |
| 2002/0156591 | A1 | 10/2002 | Newman | |
| 2006/0196695 | A1 | 9/2006 | Giroux et al. | |
| 2009/0205820 | A1 | 8/2009 | Koederitz et al. | |
| 2012/0006567 | A1 | 1/2012 | Giroux et al. | |
| 2012/0072081 | A1 | 3/2012 | Lanzl et al. | |
| 2012/0163921 | A1 | 6/2012 | Ditillo | |
| 2013/0294843 | A1 * | 11/2013 | Biserna | E02D 7/30 405/249 |
| 2016/0186552 | A1 * | 6/2016 | Penn | G05B 15/02 700/275 |

FOREIGN PATENT DOCUMENTS

| | | | |
|---|---|---|---|
| CN | 1944939 | A | 4/2007 |
| CN | 102635310 | A | 8/2012 |
| CN | 103452475 | A | 12/2013 |
| DE | 69230947 | T2 | 10/2000 |
| DE | 60011587 | T2 | 6/2005 |
| EP | 1 548 226 | A1 | 6/2005 |
| EP | 2378053 | A1 | 10/2011 |
| EP | 2468960 | A1 | 6/2012 |
| EP | 2615239 | A1 | 7/2013 |
| EP | 2662523 | A1 | 11/2013 |
| GB | 2424432 | A | 9/2006 |
| WO | 2006/012186 | A1 | 2/2006 |

OTHER PUBLICATIONS

The extended European search report issued by the European Patent Office dated Sep. 29, 2016, which corresponds to European Patent Application No. 16153082.9-1605 and is related to U.S. Appl. No. 15/095,796.

Soilmec; "SF-65"; Sep. 2012; pp. 1-8; DMD Drilling Mate System. <URL:http://www.centralpiling.com/images/central/equipment-pdfs/SF-65.pdf>.

* cited by examiner

DRILLING APPARATUS FOR PRODUCING A CASED BORE AND METHOD FOR OPERATING A DRILLING APPARATUS

The invention relates to a drilling apparatus for producing a cased bore, with a first drill drive for driving a drill rod in a rotating manner, at the lower end of which a drilling tool for removing ground material is arranged, a mast, along which the first drill drive is movable with a sledge, and a second drive, with which a support tube for the bore can be introduced into the ground, in accordance with the preamble of claim 1.

The invention further relates to a method for operating a drilling apparatus, with which a bore is produced with a support tube, in accordance with claim 6.

A drilling apparatus for producing a cased bore is known from EP 1 548 226 A1 for example. Cased bores are required for instance in the production of foundation piles in loose ground. The bore is provided with a support tube that stabilizes the wall of the bore and ensures that no ground material falls into the borehole and prevents the latter from collapsing.

Basically, there are different methods of providing a support tube on a bore. For example it is known that prior to the excavation of ground material a support tube is introduced using a vibrator or a pile driver. Afterwards, the ground material inside the support tube can be removed and excavated. This method for producing a cased bore is only practicable when specific ground conditions are present.

Furthermore, it is known that a bore is initially produced and subsequently the support tube is introduced into the bore. Likewise, this method only proves to be appropriate in the case of specific ground conditions since the wall of the bore has to be sufficiently stable until the support tube is being introduced.

A commonly used method consists in that a support tube is substantially introduced into the ground simultaneously with the production of the bore. For this purpose, a generic drilling apparatus is employed which has a first drill drive for driving a drilling tool in a rotating manner, by means of which ground material is removed and conveyed out of the borehole. In addition, the drilling apparatus has a second drive, with which the support tube is screwed into the ground.

In these known methods there exist two basic method variants. For instance, according to one variant the support tube can precede the drilling tool. This method variant is expedient, for example, when ground layers containing groundwater are being penetrated. In this case the support tube ensures that ground water is prevented from entering into the bore or expanding into other ground layers. A preceding introduction of the support tube serves as a protection against ground failure. Depending on the desired depth of the casing the support tube is composed successively of several successive tube elements.

According to a method variant the drilling tool can precede the support tube. This is especially expedient when harder ground layers are being penetrated since the preceding position of the drilling tool facilitates the subsequent introduction of the support tube.

During the sinking of a bore both method variants can also be combined depending on the ground layers to be penetrated. In this case the production of a cased bore requires a considerable degree of experience on the part of the operator of the drilling apparatus.

The invention is based on the object to provide a drilling apparatus for producing a cased bore and a method for operating such a drilling apparatus, with which a cased bore can be produced efficiently and in a particularly reliable manner.

According to the invention the object is achieved on the one hand by a drilling apparatus having the features of claim 1 and on the other hand by a method having the features of claim 6. Preferred embodiments of the invention are stated in the respective dependent claims.

The drilling apparatus according to the invention is characterized in that a computer unit is provided, in which a current drilling depth of the drilling tool and a depth of introduction of the support tube are indicated and in that a monitor is provided, on which the current drilling depth in relation to the depth of introduction of the support tube can be displayed by the computer unit.

A fundamental idea of the invention resides in the fact that by way of a computer unit the current drilling depth in relation to the depth of introduction of the support tube is displayed to the operator on a monitor. Thus, the operator can easily recognize the location of support tube and drilling tool. In particular, it can be easily determined whether the support tube precedes the drilling tool or vice versa. For the operator this simplifies the production of a cased bore to a great extent. In particular, depending on the depth the operator can also switch between the method variants, with a support tube sometimes being in a preceding position and at other times the drilling tool. Hence, the suitable method variant can always be chosen during the production of a bore across different ground layers. This permits an especially efficient and therefore cost-effective production of a cased bore.

The computer unit can be fully or partially integrated into the control of the drilling apparatus or constitute a unit independent thereof that can also be retrofitted.

A preferred embodiment of the invention resides in the fact that the second drive is an output element which is driven by a motor of the first drill drive. The first drill drive preferably consists of one or several hydraulic motors. These drive the drill rod, in particular a telescopic Kelly drill rod, preferably by way of a corresponding gear reduction. To introduce the support tube the torque of the motor of the drill drive is transmitted via the ring-shaped output element to the support tube. In this case, the second drive substantially consists of the gear unit without having its own independent motor.

On the mast of the drilling apparatus only one motor unit with two output options is located. On the one hand the Kelly bar and thus the drilling tool is driven via the hollow shaft passage and on the other hand a rotary plate, with which the drill tube can be screwed in, is driven via an output element flange-mounted at the lower end of the hollow shaft by way of a Cardan joint that is preferably interposed. The rotation gear is provided with drive shells for the Kelly bar installed at the top and with a flange for the drive of the rotary plate screwed on below.

According to a further development of the invention it is especially preferred that the first drill drive and the second drive are jointly arranged on the sledge. The sledge, which is also referred to as drill drive sledge, is moved along the mast by a feed winch. By preference, the drill rod projects through the ring-shaped first drill drive, in which case the drill rod with the drilling tool is vertically adjustable by a main winch on the drilling apparatus. The drill drive preferably constitutes a lower stop for the drill rod.

An alternative further development of the invention resides in the fact that the second drive is a casing machine which is mounted on a base structure of the drilling apparatus. The casing machine constitutes a drive unit that is independent of the first drill drive. The casing machine can have a suitable motor or drive that can apply a necessary torque and, as the case may be, a necessary axial force onto the support tube for introduction into the ground.

In this way, according to the invention a preferred embodiment is provided in that the casing machine has a pivotable collet for introducing the support tube in a rotating manner into the ground. The collet can clasp the support tube by means of hydraulic cylinders and thereby establish a torque-proof connection with the support tube. By way of further pivot cylinders a rotary movement and a torque can be applied to the support tube, whereby this is screwed into the ground.

According to the method pursuant to the invention for operating a drilling apparatus, in which a bore is produced with a support tube, provision is made in that a depth of introduction of the support tube into the ground is indicated in a computer unit, a current drilling depth of the drilling tool is detected during the production of the bore and indicated in the computer unit and by means of the computer unit the current drilling depth in relation to the depth of introduction of the support tube is displayed on a monitor.

The method is particularly for operating a previously described drilling apparatus. This results in the advantages set out beforehand.

According to a further development of the method according to the invention it is preferred that the detection of the current drilling depth of the drilling tool takes place via a first sensor means. In particular, the sensor means can comprise measuring means which detect a wound-off length of the main rope of the main winch for vertical movement of the drill rod and/or for determining of the wound-off length of the feed winch, through which the sledge with the first drill drive is moved along the mast. Basically, use can also be made of other sensor means for determining the current drilling depth, such as optical sensors or a depth measurement by means of ultrasound or laser.

Another advantageous embodiment of the method according to the invention resides in the fact that the input of the depth of introduction of the support tube takes place manually via an operation terminal or automatically via a second sensor means. The length of the support tube as a gauge for the depth of introduction can be directly input by the operator into the computer unit, for instance via a corresponding input field that can be shown on the monitor. In this case, it is assumed that the support tube is introduced in its entirety into the ground. The input can also take place automatically, for example by way of a means for reading a corresponding marking on the support tube, such as an RFID-tag. On this tag all relevant information relating to the support tube, in particular concerning the length and thus the depth of introduction of the support tube, can be stored. Furthermore, provision is preferably made for a current depth of introduction of the support tube to be determined by the second sensor means. Depending on the type of drive arrangement this can also be effected by a corresponding determination of location of the sledge with the second drive for introducing the support tube or by corresponding optical sensors. Even when a casing machine is used the current depth of introduction of the support tube can be determined reliably by a corresponding sensor means. This can be implemented e.g. by detecting the movement of the collet or also via optical sensors for determining the location of the support tube.

According to the invention a preferred method variant resides in that the detection of the current drilling depth takes place by means of a position measurement of a sledge of a first drill drive and/or a location measurement of a drill rod, at the lower end of which the drilling tool is mounted. For this purpose the afore-described sensor means can be used.

Basically, a display of the current drilling depth in relation to the depth of introduction of the support tube can be realized in any chosen way.

According to a further development of the invention a particularly illustrative display results from the fact that by way of the computer unit a bar display of the depth of introduction of the support tube and of the current drilling depth is generated on the monitor. Especially when the bars are in vertical alignment the current location of the drilling tool with respect to the lower end of the support tube is rendered particularly clear and illustrative. In particular, the support tube can be displayed in a cross-sectional view with two lateral lines and a corresponding horizontal transverse line to define a lower and upper edge. The drilling tool can be shown in a figurative manner or stylized as a horizontal bar in the support tube.

Advantageously, the method according to the invention is developed further in that the support tube is composed of at least two support tube elements, wherein an additive overall display of the depth of introduction is provided. Through a corresponding input of the length of an additional support tube the maximum depth of introduction of the support tube is increased and adapted accordingly. The display on the monitor changes accordingly. If the support tube with the additional support tube element attached at the top is then introduced further into the ground the depth of introduction and the related display on the monitor changes accordingly. Basically, the introduced support tube can be composed of a plurality of support tube elements of different length. The length of the individual support tube elements can be input into the computer unit via a suitable input field that can be shown on the monitor. Basically, the input can also take place by a choice of predetermined standard lengths of support tube elements. By preference, provision is made for an automatic recognition and input, for instance by way of a previously described RFID-tag on the support tube element.

Another preferred embodiment variant of the method according to the invention resides in that on the monitor the support tube or the support tube element is displayed on the monitor before and after introduction into the ground. On the monitor the support tube with the additional support tube element attached on top is shown in an initial state. In this, the support tube or the respective support tube element is located above a displayed ground surface. After corresponding introduction the support tube introduced is displayed with the maximum depth of introduction or the actual depth of introduction currently reached.

The support or drill tube can be screwed into the building ground both by means of the rotary plate of the rotary drive displaceable on the mast of the drilling apparatus and with the casing machine. When screwing the drill tube in by means of a rotary plate the current depth of introduction of the drill tube can be determined by means of the transducers mounted on the feed system. To this end the position of the rotary drive along the mast is determined and offset against the current drilling depth of the drilling tool. The position of the rotary drive can be determined by displacement transducers along the mast or displacement transducers on the feed system, e.g. on the feed rope. The total length of the drill tube can be determined either by input of the driver or by automatic recognition of the individual drill tube sections for example by means of RFID-tags. The length of the individual drill tube sections is summed up to a total drill tube length. The drilling depth of the drilling tool can be determined, for example, by way of the depth measurement of the main rope winch that moves the Kelly bar and by way of the current locking position of the Kelly bar. There is also the option that through an input of the driver a zero position of the depth of drilling is defined when the upper edge of the drill tube has been reached by the drilling tool bottom. This makes it possible to offset the current drilling depth against the previously calculated total drill tube length and to determine a difference between drilling depth and installed drill tube length.

If the depth of installation of the drill tube is determined by a measuring system on the mast of the drilling apparatus it has to be defined through switching or triggering as to whether the drill tube is screwed in or the drill tube is being drilled out. This triggering can be effected either through an input of the driver or, in the case of automatic rotary tables, it can take place automatically through actuation of the tube fixing means.

The invention is described further hereinafter by way of preferred embodiments illustrated schematically in the accompanying drawings, wherein show:

FIG. 1: a schematic side view of a drilling apparatus according to the invention and FIGS. 2*a* to 2*i*: bar displays of a support tube and a bore according to the invention.

According to FIG. 1 a drilling apparatus 10 pursuant to the invention has an undercarriage 12 designed as a crawler-track running gear and an upper carriage 14 supported thereon in a rotatable manner. The undercarriage 12 and the upper carriage 14 form a base structure 15. On the upper carriage 14 the drive units and the operator's stand for the drilling apparatus 10 are arranged in a known manner.

On a front side of the upper carriage 14 a vertical mast 18 with an upper mast head 19 is mounted in an adjustable manner via a kinematic linkage mechanism 16 with neck cylinders. Along a front side of the mast 18 a sledge 20 is guided in a displaceable manner. On the sledge 20 a first drill drive 22 is provided that has a hydraulic motor 24. Moreover, on the sledge 20 a second drive 26 with a sleeve-shaped rotary connection 27 is provided for establishing a torque-proof connection to a support tube 4. The second drive 26 substantially consists of a gear connection to the first drill drive 22 with the hydraulic motor 24 in order to thereby apply a torque to the rotary connection 27 and thus the support tube 4.

The approximately sleeve-shaped first drill drive 22 is penetrated by a drill rod 30 which is designed as a Kelly rod with external drive keys. The drill rod 30 has an upper suspension 32, by which the drill rod 30 is connected to a main rope 39. The main rope 39 is guided via deflection rollers on the mast head 19 to a main winch 38 on the upper side of the upper carriage 14. Through actuation of the main winch 38 the drill rod 30 can be moved vertically.

The sledge 20 is connected to a feed rope 37 which is guided above and below the sledge 20 along the mast 18 and actuated by a feed winch 36. Through the feed winch 36 the sledge 20 can be moved upwards or downwards along a guide of the mast 18.

On an underside of the drill rod 30 a drilling tool 34 for removing ground material is mounted. In the illustrated embodiment according to FIG. 1 the drilling tool 34 is designed as a drilling bucket. The diameter of the drilling tool 34 is designed such that it can be introduced into the inner hollow space of the support tube 4.

With the drilling apparatus 10 a cased bore can be produced in the ground 1. For an efficient production of a cased bore a coordinated introduction of the support tube 4 with the sinking of the bore is necessary. According to FIG. 1 in a first step the support tube 4 is introduced up to a first depth of introduction into the ground 1.

Figure 2E:
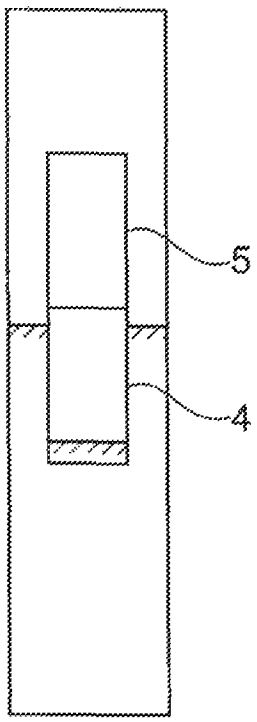
Figure 2D:
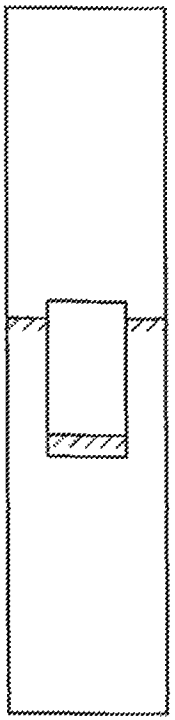
Figure 2C:
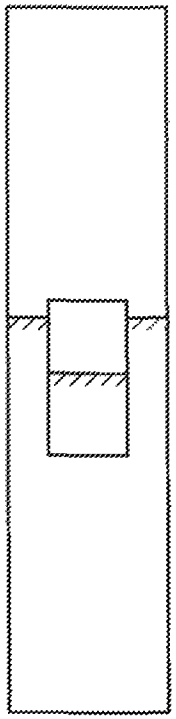
Figure 2B:
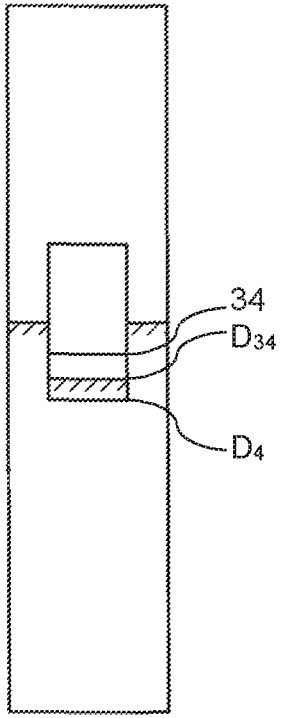
Figure 2A:
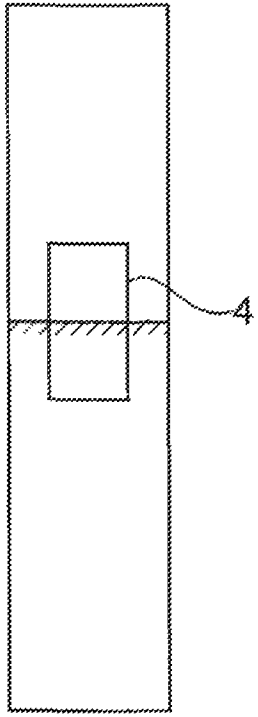
Figure 2I:
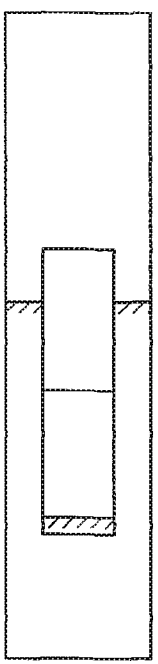
Figure 2H:
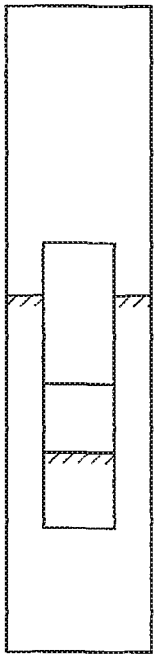
Figure 2G:
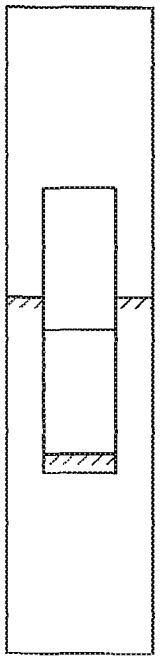

This state is illustrated schematically in FIG. 2*a* which shows a bar diagram provided according to the invention that can be shown on a monitor to the operator in the drilling apparatus 10. According to the illustration of FIG. 2*a* an excavation of ground has not yet taken place.

In this way, the tube length of the support tube 4 can be input by the operator on the monitor of a computer unit. For the depth measurement a lower edge of the drilling tool 34 is set to zero on the upper edge of the support tube. In this way, the relation between drilling tool 34 and support tube 4 is logged in the computer unit.

According to FIG. 2*b* the next step consists in drilling the ground 1 out of the support tube 4 with the drilling tool 34. Through depth measurement carried out with a first sensor means on the main winch 38 the drilling progress can be controlled on the monitor of the computer unit. Both the length of the support tube 4 and the drilling depth $D_4$ reached are shown graphically on the monitor of the computer unit. The downward shifted horizontal bar inside the support tube 4 in FIG. 2*b* indicates the drilling depth $D_{34}$ of the drilling tool 34. In addition, the drilling tool 34 can be shown with an additional horizontal bar inside the support tube 4 on the monitor in the operator's stand.

By preference, the difference of the support tube length and the drilling depth reached can be additionally displayed on the monitor as a measured value of the position of the drilling tool 34 with respect to the support tube 4. In this way, in addition to the graphic display the driver of the apparatus is provided with a gauge as to whether drilling is being carried out with the drilling tool 34 in a preceding or lagging position with respect to the support tube 4. In certain ground layers this gauge is of vital importance for the ensuing quality of the drilled pile produced.

In a further step according to FIG. 2*c* the support tube 4 is once again coupled with the second drive 26, which can also be referred to as a rotary drive head, and screwed further into the ground 1.

Recording of the new relation of depth measurement is effected in that the driver of the apparatus carries out a reset with the lower edge of the drilling tool 34 on the upper edge of the support tube 4 or by measuring the depth of introduction reached through the depth measurement on the feed winch 36 by means of a second sensor means. For the measurement of introduction through the depth measurement of the feed winch 36 a specific mode can be present in the computer unit for an input by the driver of the apparatus or an automatic recognition of the coupling of the second drive 26 with the support tube 4 can take place.

After decoupling of the second drive 26 from the support tube 4 a further drilling-out inside the support tube 4 is then effected in accordance with FIG. 2*d*. This can take place in one or several drilling processes.

In this way, the steps according to FIGS. 2*b* to 2*d* can be carried out several times in succession.

According to FIG. 2*e* an additional support tube element 5 is then attached, whereby an extended support tube 4 is formed. The length of the support tube 4 is determined in the computer unit and displayed graphically according to FIG. 2*e*.

To this end, the length of the additionally attached support tube element 5 is added to the previously known length of the support tube 4. Recognition of the length of the additionally attached support tube element 5 takes place through the input into the computer unit made by the driver of the apparatus or through automatic recognition of the tube length by an identification system of the support tube 4/support tube elements 5 e.g. by means of an RFID-tag.

To relate the depth measurement once again to the upper edge of the support tube 4 this is set to zero by a reset carried out by the driver of the apparatus with the lower edge of the drilling tool 34 on the upper edge of the support tube 4 or, through automatic correction of the drilling depth reached, the said depth measurement is adjusted by the indicated or detected length of the support tube 4 supplemented with the support tube element 5. As a result, a correction of the depth measurement can take place automatically.

Figure 2F:
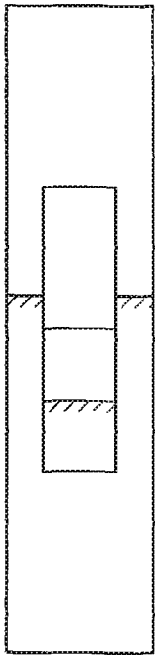

Through renewed coupling of the extended support tube 4 with the second drive 26 the support tube 4 is screwed deeper into the ground 1, as can be gathered from FIG. 2*f*. Afterwards a further drilling-out and removal of ground material from the support tube 4 is effected in accordance with FIG. 2*g*. The screwing-in of the extended support tube 4 and the drilling-out of the ground material located therein can also take place in several steps, as can be taken from FIGS. 2*h* and 2*i*.

The method illustrated in FIGS. 2*a* to 2*i* shows the support tube 4 as being in a preceding position with respect to the bore 2. By way of the graphic display this can be easily controlled by the operator. Accordingly, the bore can also be in a preceding position with respect to the support tube.

The invention claimed is:

1. A drilling apparatus for producing a cased bore, comprising:

a first drill drive for driving a drill rod in a rotating manner, at the lower end of which a drilling tool for removing ground material is arranged, a mast, along which the first drill drive is movable with a sledge, and a second drive, with which a support tube for the cased bore can be introduced into the ground, wherein the drilling tool is configured to be moved in and out of an inner hollow space of the support tube, a computer unit is provided, in which a current drilling depth of the drilling tool and a depth of introduction of the support tube are indicated, and a monitor is provided, on which the current drilling depth in relation to the depth of introduction of the support tube is displayed by the computer unit, which provides a gauge as to whether drilling is being carried out with the drilling tool in a preceding position or in a lagging position with respect to the support tube.

2. The drilling apparatus according to claim 1, wherein the second drive is an output element which is driven by a motor of the first drill drive.

3. The drilling apparatus according to claim 1, wherein the first drill drive and the second drive are jointly arranged on the sledge.

4. The drilling apparatus according to claim 1, wherein the second drive is a casing machine which is mounted on a base structure of the drilling apparatus.

5. The drilling apparatus according to claim 4, wherein the casing machine has a pivotable collet for introducing the support tube in a rotating manner into the ground.

6. The drilling apparatus according to claim 1, wherein, when the drilling tool is in the lagging position with respect to the support tube, the computer unit and monitor are configured to display one or more displays configured for the lagging position, and wherein, when the drilling tool is in the preceding position with respect to the support tube, the computer unit and monitor are configured to display one or more displays configured for the preceding position.

7. The drilling apparatus according to claim 6, wherein, when the drilling tool is in the lagging position with respect to the support tube, the computer unit and monitor are configured to display the following:

a first display of a first condition of the drilling apparatus, wherein excavation of the ground has not yet taken place, and which is to display a tube length of the support tube relative to an initial depth of a lower edge of the drilling tool, a second display of a second condition of the drilling apparatus, wherein the ground is drilled out of the support tube with the drilling tool, wherein both the length of the support tube and the drilling depth reached are shown, a third display of a third condition of the drilling apparatus, wherein the support tube is once again coupled with the second drive and screwed further into the ground and a new relation of depth measurement is effected, a fourth display of a fourth condition of the drilling apparatus after decoupling of the second drive from the support tube and a further drilling-out inside the support tube is effected, a fifth display of a fifth condition of the drilling apparatus, wherein an additional support tube element is attached, and an extended support tube is formed, a sixth display of a sixth condition of the drilling apparatus after renewed coupling of the extended support tube with the second drive and after the extended support tube is screwed deeper into the ground, a seventh display of a seventh condition of the drilling apparatus, wherein further drilling-out and removal of the ground material from the support tube is effected, an eighth display of an eighth condition of the drilling apparatus after screwing-in of the extended support tube, and a ninth display of a ninth condition of the drilling apparatus after drilling-out of the ground material located in the extended support tube.

8. The drilling apparatus according to claim 7, wherein, in the second display, a downward shifted horizontal bar is displayed inside the support tube, which indicates the drilling depth of the drilling tool.

9. The drilling apparatus according to claim 8, wherein, in the second display, the drilling tool is shown with an additional horizontal bar inside the support tube on the monitor.

10. A method for operating a drilling apparatus, in which a cased bore is produced with a support tube, the drilling apparatus comprising:

a first drill drive for driving a drill rod in a rotating manner, at the lower end of which a drilling tool for removing ground material is arranged, a mast, along which the first drill drive is movable with a sledge, and a second drive, with which the support tube for the cased bore can be introduced into the ground, wherein the drilling tool is configured to be moved in and out of an inner hollow space of the support tube, a computer unit is provided, in which a current drilling depth of the drilling tool and a depth of introduction of the support tube are indicated, and a monitor is provided, on which the current drilling depth in relation to the depth of introduction of the support tube can be displayed by the computer unit, which provides a gauge as to whether drilling is being carried out with the drilling tool in a preceding position or in a lagging position with respect to the support tube, wherein the method comprises:

indicating the depth of introduction of the support tube into the ground in the computer unit, detecting the current drilling depth of the drilling tool during the production of the cased bore and indicating the current drilling depth in the computer unit and displaying by means of the computer unit the current drilling depth in relation to the depth of introduction of the support tube on the monitor.

11. The method according to claim 10, wherein the detection of the current drilling depth of the drilling tool takes place via a sensor.

12. The method according to claim 10, wherein the input of the depth of introduction of the support tube takes place manually via an operation terminal or automatically via a sensor.

13. The method according to claim 10, wherein the detection of the current drilling depth takes place by means of a position measurement of the sledge of the first drill drive and/or a location measurement of the drill rod, at the lower end of which the drilling tool is mounted.

14. The method according to claim 10, wherein by way of the computer unit a bar display of the depth of introduction of the support tube and of the current drilling depth is generated on the monitor.

15. The method according to claim 10, wherein the support tube is composed of at least two support tube elements, wherein an additive overall display of the depth of introduction is provided.

16. The method according to claim 10, wherein on the monitor the support tube or a support tube element of the support tube is displayed on the monitor before and after introduction into the ground.

17. The method according to claim 10, wherein, when the drilling tool is in the lagging position with respect to the support tube, the computer unit and monitor are configured to display one or more displays configured for the lagging position, and wherein, when the drilling tool is in the preceding position with respect to the support tube, the computer unit and monitor are configured to display one or more displays configured for the preceding position.

18. The method according to claim 17, wherein, when the drilling tool is in the lagging position with respect to the support tube, the computer unit and monitor are configured to display one or more of the following:

a first display of a first condition of the drilling apparatus, wherein excavation of the ground has not yet taken place, and which is to display a tube length of the support tube relative to an initial depth of a lower edge of the drilling tool, a second display of a second condition of the drilling apparatus, wherein the ground is drilled out of the support tube with the drilling tool, wherein both the length of the support tube and the drilling depth reached are shown, a third display of a third condition of the drilling apparatus, wherein the support tube is once again coupled with the second drive and screwed further into the ground and a new relation of depth measurement is effected, a fourth display of a fourth condition of the drilling apparatus after decoupling of the second drive from the support tube and a further drilling-out inside the support tube is effected, a fifth display of a fifth condition of the drilling apparatus, wherein an additional support tube element is attached, and an extended support tube is formed, a sixth display of a sixth condition of the drilling apparatus after renewed coupling of the extended support tube with the second drive and after the extended support tube is screwed deeper into the ground, a seventh display of a seventh condition of the drilling apparatus, wherein further drilling-out and removal of the ground material from the support tube is effected, an eighth display of an eighth condition of the drilling apparatus after screwing-in of the extended support tube, and a ninth display of a ninth condition of the drilling apparatus after drilling-out of the ground material located in the extended support tube.

19. The drilling apparatus according to claim 18, wherein, in the second display, a downward shifted horizontal bar is displayed inside the support tube, which indicates the drilling depth of the drilling tool.

20. The drilling apparatus according to claim 19, wherein, in the second display, the drilling tool is shown with an additional horizontal bar inside the support tube on the monitor.

* * * * *